United States Patent [19]

Martin

[11] 4,452,007

[45] Jun. 5, 1984

[54] HORIZONTAL AXIS ROTATORY FRUSTUM FLYING TOY

[76] Inventor: Lynn W. Martin, 2314 Hiram, Wichita, Kans. 67213

[21] Appl. No.: 367,684

[22] Filed: Apr. 12, 1982

[51] Int. Cl.[3] ..... A63H 27/00; A63H 27/14

[52] U.S. Cl. ..... 446/45; 244/21; 273/428; 416/4; 124/1; 446/255

[58] Field of Search ..... 46/74 R, 76 R, 77, 78, 46/79, 81; 244/10, 21, 153 A, 39; D21/82, 85, 88, 89; 273/428, 318, 327; 416/4

[56] References Cited

U.S. PATENT DOCUMENTS

| | | | |
|---|---|---|---|
| 1,725,316 | 8/1929 | Strong | 244/10 |
| 1,807,353 | 5/1931 | Tarshis | 416/4 |
| 1,927,538 | 9/1933 | Zaparka | 244/10 |
| 2,030,302 | 2/1936 | Jones | 46/60 |
| 2,167,992 | 8/1939 | Olsen | 273/318 X |
| 3,140,065 | 4/1964 | Alvarez-Calderon | 244/10 |
| 3,559,331 | 2/1971 | Eller | 46/74 R |
| 4,051,622 | 10/1977 | Sharp | 46/74 R |
| 4,064,647 | 12/1977 | Lemelson | 46/81 |
| 4,329,807 | 5/1982 | Atkinson | 46/81 |
| 4,339,138 | 7/1982 | DiManno | 273/428 |
| 4,366,386 | 12/1982 | Hanson | 416/11 X |

FOREIGN PATENT DOCUMENTS

| | | | |
|---|---|---|---|
| 2346096 | 3/1975 | Fed. Rep. of Germany | 244/153 A |
| 1601665 | 10/1970 | France | 273/428 |

OTHER PUBLICATIONS

Model Airplane News, Apr. 1931, Article entitled "Rotor Flying Model" by T. N. de Brobovsky, pp. 9–15.

*Primary Examiner*—F. Barry Shay

[57] ABSTRACT

The Horizontal Axis Rotatory Frustum Toy is a catapulted cylinderlike flying-wing glider that rotates horizontally to produce lift and quite slow flight, suitable indoors or out. A rubber band or string can be used to launch it. Unique shape provides good lateral stability. The design principle may have military dispersion bomb applications.

6 Claims, 9 Drawing Figures

HORIZONTAL AXIS ROTATORY FRUSTUM FLYING TOY

The present invention relates to a free flying aircraft with a wing of the rotating horizontal cylinder type, known to the aerodynamic art as a Magnus-lifting-effect-rotor. It is well known that a magnus rotating cylinder can produce the aerodynamic circulation portion of the airflow around an airfoil which when superimposed on linear airflow perpendicular to the cylinder axis can produce considerable lift. Unfortunately, the circular wing cross section also produces considerable drag so the configuration has not had until now significant practical application.

The free flying aircraft invention herein described uses this magnus-lifting-effect principle to generate lift and may be used as a toy or for such things as the shape of bombs or bomblets for aerodynamic dispersion purposes.

The aircraft configurations described herein are devoted to simple tailless flying-wing shapes and it will be understood that the invention is not to be construed as limited to such since fuselage and tail may be added if desired by those skilled in the art. By way of experimental discovery, ways have been found to make a rotating cylinderlike free flying aircraft fly with rather good inherent lateral stability and for launching such a machine with initial Magnus rotor flight parameters of rotation and translation provided by the launch action.

Full size known aircraft have been built with rotary cylinder wings and to achieve lateral stability the right and left wings were constructed with mechanical dihedral, so the right and left wings were not on the same rotary axis. The wing configurations shown herein that have good lateral stability have their right and left wings on the same rotary axis and do not have mechanical dihedral; according to the invention external flange ribs located toward the wing tips and/or reshaping the spanwise rotary wing planform produce an interactive airflow between downwash and vortices which causes an aerodynamic effect or rotor structure effective dihedral to establish good lateral stability.

By experiment, it was found that for a toy the unique rotary wings described herein could be launched by hand alone in a similar manner to putting reverse spin on a baseball, or preferably by a string or rubber band wrapped around the wing and forcefully unwound to cause the wing to rotate, move forward, and separate from the launcher. Many power drive means for launch can be designed to suit these special purposes so only one simple mechanism is shown herein. It is preferred although not required for the rotary wing to be launched forward with the top surface rotating toward aft for immediate upward lift. However, the opposite wing rotation simply produces temporary down lift and is equivalent to entering a flight trajectory at the top of a loop.

As a toy, it is important to construct the aircraft as light as possible since it will have longer flight times. For a given lift-over-drag ratio, the lighter the aircraft, the slower the glide, the longer the flight time. A very light weight aircraft made from such materials as plastic foam shows good results in sustaining flight when in updrafts and thermals. It is also important to keep as much mass of the aircraft as possible in the outer diameters of the components because rotational inertia is a function of diameter squared and high rotational inertia will keep the aircraft rotating to produce lift. The invention will appear more fully from the examples which follow. These examples are set forth by way of illustration only; and it will be understood that the invention is not to be construed as limited either in spirit or in scope by the details contained therein as many modifications both in materials, configuration, and methods will be apparent from this disclosure to those skilled in the art.

The term 'frustum' is used extensively herein to mean according to Webster, "The part of any solid intersected between two (usually parallel) planes"; except that in regular use (similar to the thought that a funnel is conical, although a cone is defined as solid) the frustums herein may be solid, hollow, or a thin walled surface as in the 'skin' of an airplane.

Figure 4:
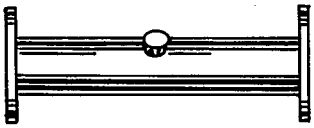
Figure 5:
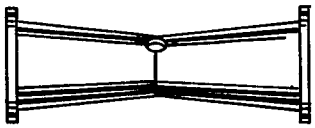
Figure 6:
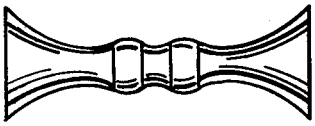

FIGS. 4, 5, and 6 are other wing planform examples and serve to demonstrate the variety of planform shapes, some being better than others as will be discussed in the detail description. All the wings shown have circular wing sections although other generally circular sections are acceptable.

Figure 7:
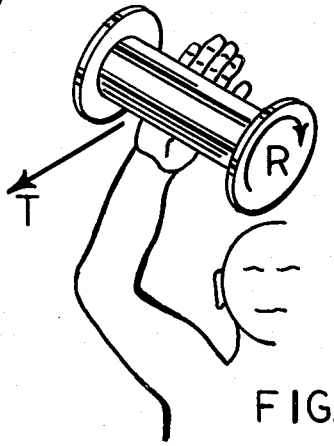

FIG. 7 shows an aircraft being launched by only the hand.

Figure 8:
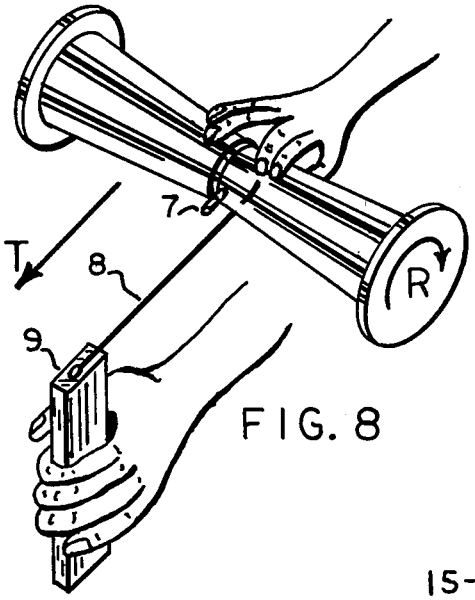
Figure 9:
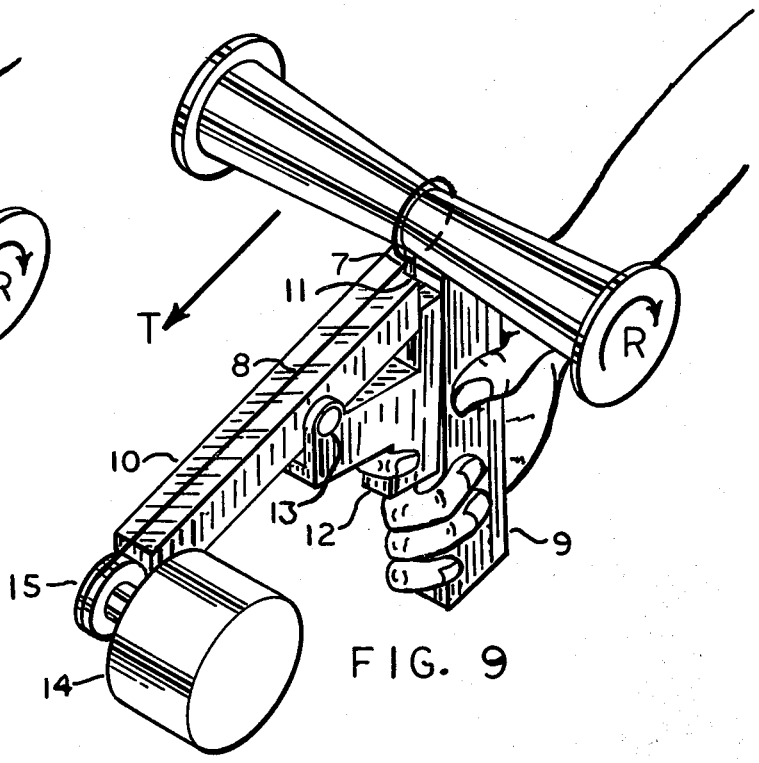

FIG. 8 shows an example aircraft being launched by hand with the aid of a string and hand grip. The aircraft rotor rotation 'R' of an aircraft launched as shown in FIGS. 7, 8, and 9 is generally about the lateral axis (aerodynamic art convention) of the rotor. The lateral axis runs through the centers of the rotor ends and in this case is coincident with the aircraft lateral axis. The lateral axis is perpendicular to the direction of flight as shown by arrow 'T', which is generally parallel to the longitudinal axis (aerodynamic art convention) that intersects the lateral axis at the midportion of the aircraft. As can be seen from the drawing, the aircraft rotor is symmetrical to each side of the longitudinal axis, along or parallel to the lateral axis.

FIG. 9 shows an aircraft example being launched with the aid of a cockable trigger release launcher and with an optional power drive. Note that FIGS. 7, 8, and 9 show the translational direction of launch with an arrow designated "T" and the preferred direction of aircraft rotation designated as arrow "R".

Figure 1:
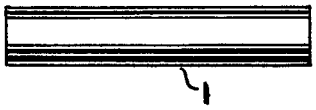
FIG. 1 is a wing planform view of a basic rotatory cylinderlike flying-wing.

The cylinderlike aircraft in FIG. 1 is shown to demonstrate the most basic form of a free flying generally horizontal axis rotatory frustum. It is composed of a cylinder 1 (shown in wing planform view); and it may be solid, hollow, or may have a thin walled surface or skin. When the cylinder 1 is rotating about its usually horizontal cylinder axis and has linear movement through the air in a direction generally across or perpendicular to the cylinder axis, circulation lift is produced on the cylinder and it can be made to fly. This Magnus effect rotating cylinder circulation lift principle is well known and is not part of this invention. A toy of sufficiently light weight for adequate lift-to-weight ratio and rotational inertia-to-weight ratio can be nothing more than the cardboard tube from a roll of toilet paper; however, such a tube needs launching with the appropriate rotation and translation Magnus rotor flight parameters imparted during the launch to cause the tube to fly, and this combination is part of this invention.

Figure 2:
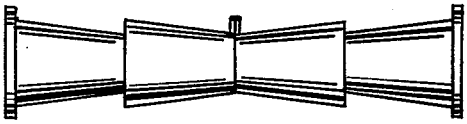
FIG. 2 is a wing planform view of an improved rotatory frustum flying-wing and it is shown in an exploded orthographic view in FIG. 3.

FIG. 2 shows an example wing planform of a unique rotary wing aircraft that contains all the basic combinations of aircraft wing components that make up a simple rotary flying-wing; although a tail and fuselage could be added when desired by one skilled in the art. FIG. 2 is shown in order to relate to other example wing planforms shown in FIGS. 4, 5, and 6. The flying-wing in FIG. 2 is shown in an exploded orthographic view by FIG. 3.

Figure 3:
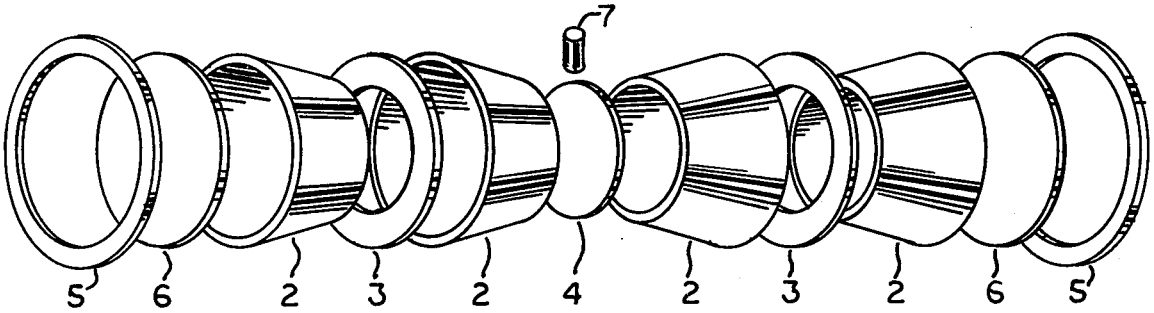

In FIG. 3, four rotatory frustums 2 are connected together by closure ribs 3 and a central plane stiffener rib 4. External flange ribs 5 are attached at the wing tips and closure membranes or ribs 6 are added at the same location. A launcher engager 7 may be added at the central plane of the aircraft (for engaging a catapulting launcher) and it may be a pin, knob, hole, hook, clip, or the like.

The right and left rotary wing surfaces extending from the central plane are mainly made up of the four frustums 2 (which in this example are thin skin conical frustums) symmetrically extending from the central plane; this symmetry is also shown by all the wing planform examples shown. The frustums may be of circular wing cross section and as part of this invention it is preferred that they have larger wing sections on their outboard ends to cause an inherent lateral stability or an effective dihedral. The example wing planform configuration in FIG. 5 is a simpler use of two conical frustums to achieve an effective dihedral. The example wing planform in FIG. 6 shows a configuration with several odd shaped frustum surfaces which can still provide some lateral stability, so long as the total integrated aerodynamic effect of all the frustums is effective dihedral.

Closure ribs 3 and 6 in FIG. 3 seal the aircraft so that external and internal air do not mix during flight in order to improve efficiency; and they in themselves are not new but their combination with the example aircraft is part of this invention. Experiments have shown that they provide significant flight improvement for light weight toy configurations. The closure 6 may be either structural or non-structural depending on strength requirements of a specific design.

The central plane stiffener rib 4 serves to hold wing section shape under stress from launcher contact and as a reinforcement mount for the launcher engager.

External flange ribs 5 are mounted at the wing tips and act to increase effective aspect ratio of the wing. This action is known and is not part of this invention except as it applies to the aircraft system combination. However, these external ribs 5 when provided the correct (requires experimental work on each configuration) proportional diameters relative to the aircraft size also provide a side force to reduce aircraft slips and slides; and causes a yaw-roll aerodynamic interaction at the wing tips which induces lateral stability and effective dihedral which is part of this invention. The aircraft wing planforms in FIGS. 2 and 5 use these external flange ribs at the wing tips to enhance the effective dihedral already inherent in their conical frustum lifting surfaces. The example wing configuration in FIG. 6 combines both effective dihedral means by blending the two components so that the flange ribs become an integral part of the wing tip frustums. The wing planform configuration in FIG. 1 has neutral lateral stability due to the lack of this inventions lateral stability devices although it can be satisfactory as part of a simple aircraft and launcher system; although a simple wing configuration as in FIG. 4 dihedral effect with external ribs at the wing tips is preferred.

In FIG. 7, an example free flying rotatory frustum flying-wing is shown being launched by hand without the aid of a launcher system. This requires some skill to meet Magnus rotor flight parameters and is achieved by throwing the aircraft forward in the direction of the translation arrow T and simultaneously letting the aircraft roll backwards off the fingers to impart a rotation in the direction of rotation arrow R; this is similar to putting reverse spin on a baseball where the top surface is moving aft relative to the total movement forward. This method works best with an aircraft of wing section size similar to a baseball for the obvious reason that it fits the human factors of the hand.

In FIG. 8, an example rotatory frustum flying-wing or rotary cylinderlike aircraft has a launcher engager or string-end engager pin 7 on the lifting surface at the central plane with a catapulting launcher string 8 connected to the pin by a loose loop on the string end, string 8 being wrapped around the center of the aircraft wing in the same direction as the desired direction of rotation arrow R, a portion of string 8 extending forward in the direction of desired flight arrow T, and a hand grip 9 attached to the free end of string 8. By holding the aircraft with one hand as shown and the string or hand grip with the other hand, releasing the hand holding the aircraft, and simultaneously forcing the string forward, the string 8 is unwound from the aircraft imparting a rotation R and a translation T until the string 8 disengages from the launcher engager pin 7, releasing the aircraft to free flight. The use of the launcher engager 7 is preferred since otherwise the last loop portion of string 8 would not impart power to the aircraft. The launcher string 8 may be elastic like a rubber band in which case some or all of the launch action may be produced by the power in the stretched elastic string or band.

In FIG. 9 the aircraft system includes a typical mechanized catapulting launcher design utilizing the launcher engager pin 7, catapulting launcher string 8, and hand grip 9 similar in action to that shown in FIG. 8; with the addition of a launcher rail 10 attached to hand grip 9, a slot 11 in launcher rail 10 to hold the engager pin 7 and the extended portion of trigger 12, trigger 12 mounted by pivot 13 onto the launcher rail 10, and an optional power drive motor 14 with a pulley 15 to pull on string 8.

When the optional power drive motor 14 with pulley 15 is not used, the catapult launcher string 8 is attached to the end of launcher rail 10 and must obviously be elastic for the power source; the trigger 12 then acts as a cockable release wherein the elastic string is first stretched around the aircraft, the aircraft pulled back until the engager pin 7 is inserted in slot 11 forcing the extended portion of trigger 12 downward and the trigger finger forward. Pulling back the trigger 12 pushes the engager pin 7 out of the slot 11, thereby releasing the power pull of the string 8 to launch the aircraft in the direction of translation arrow T and imparts a rotation R until the string 8 disengages from the launcher engager pin 7 which releases the aircraft to free flight. The optional power drive 14 may be of any method known to the art such as spring wound, or pneumatic, or an electric motor and it may contain its own power supply; and it is not part of this invention except as in combination with the aircraft system.

What is claimed is:

1. In a rotor aircraft having a generally-circular-cross-section elongate frustum portion having lateral and longitudinal axes intersecting at its center, said elongate frustum portion having a continuous circumferential surface extending symmetrically from a plane containing the longitudinal axis and, said plane being perpendicular to said lateral axis, said surface terminating at opposed end portions, an improvement in the aerodynamic structural configuration of said rotor aircraft for enhancing said aircraft's effective dihedral and lateral stability, said improvement comprising said elongate frustum portion comprising more than one smaller conelike frustum, each said conelike frustum having its smaller periphery closer to the midportion of said elongate frustum portion and rotor aircraft than its larger periphery, each smaller periphery that is adjacent to a larger periphery being smaller than the adjacent larger periphery; the physical characteristics of said aircraft, including its dimensions and weight, being selected to enhance the ease of imparting to it rotatory and translational motions which meet Magnus rotor flight parameters; and a further improvement comprising means at the midportion of said rotor aircraft for temporarily connecting means to launch said aircraft.

2. In combination, a rotor aircraft structure and catapulting launcher; said rotor aircraft comprising a generally-circular-cross-section elongate frustum portion having lateral and longitudinal axes intersecting at its center, said elongate frustum portion having a continuous circumferential surface extending symmetrically from a plane containing the longitudinal axis, said plane being perpendicular to said lateral axis, said surface terminating at opposed end portions, said elongate frustum portion having a launcher-engaging means located near its midportion; the physical characteristics of said aircraft, including its dimensions and weight, being selected to enhance the ease of imparting to it rotatory and translational motions which meet Magnus rotor flight parameters; and said catapulting launcher comprising a catapulting launcher line adapted to engage said launcher-engaging means so as to allow said line to be wrapped about said elongate frustum portion in a direction around said lateral axis, tensioned movement of said line means away from said elongate frustum portion causing said line to disengage from said rotor aircraft, imparting a rotation to the elongate frustum portion generally about its lateral axis, and imparting a foward thrust relative to said catapulting launcher whereby said rotor aircraft will be launched.

3. A combination as in claim 2 wherein said rotor aircraft also has platelike rib means attached to said elongate frustum portion near said opposed end portions, said rib means being of larger diameter than said opposed end portions of said elongate frustum portion, for improving the effective dihedral and lateral stability of said rotor aircraft.

4. A combination as in claim 2 wherein said rotor aircraft also has the aerodynamic shape of said elongate frustum portion comprising more than one smaller conelike frustum, each said conelike frustum having its smaller periphery closer to the midportion of said elongate frustum portion and rotor aircraft than its larger periphery, and each smaller periphery that is adjacent to a larger periphery being smaller than the adjacent larger periphery, for improving the effective dihedral and lateral stability of said rotor aircraft.

5. A method for catapult launching a Magnus-rotor-lifting-effect aircraft, said aircraft including a Magnus rotor, said method comprising temporarily connecting a line to the rotor, wrapping the line around the rotor, holding the aircraft with one hand and the line with the other hand, releasing the aircraft-holding-hand, and pulling suitably hard and long on the line with sufficient skill to impart rotatory and translational motion meeting Magnus rotor flight parameters to the rotor while the line unwinds and disengages from the rotor.

6. A method for catapult launching a Magnus-rotor-lifting-effect aircraft, said aircraft including a Magnus rotor, said method comprising temporarily connecting a suitable strength elastic line to the rotor; stretching the line to a suitable energy level required by known Magnus-rotor-lifting-effect data for flight; wrapping a portion of the tensioned elastic line around the rotor; stretching and tensioning a portion of the line forward along the aircraft's longitudinal axis in a direction of intended flight; said tensioned line wrapped and line forward portions being proportioned to impart rotatory and translational motion meeting Magnus rotor flight parameters to the rotor during said catapult launch; restraining the aircraft while performing the foregoing steps wherein the line is stretched and tensioned; and then releasing the aircraft whereby the rotor is spun and the aircraft launched forward into free flight by the elastic line.

* * * * *

UNITED STATES PATENT AND TRADEMARK OFFICE

CERTIFICATE OF CORRECTION

PATENT NO. : 4,452,007

DATED : June 5, 1984

INVENTOR(S) : Lynn W. Martin

It is certified that error appears in the above-identified patent and that said Letters Patent is hereby corrected as shown below:

Column 1, line 8, "magnus" should read -- Magnus --.

Column 1, line 17, "magnus" should read -- Magnus --.

Column 4, line 1, after "FIG. 4" should read -- with --.

Column 4, line 1, after "dihedral effect" delete "with".

Column 5, claim 1, line 6, after "axis" delete "and".

Signed and Sealed this

*Eleventh* Day of *September 1984*

[SEAL]

*Attest:*

GERALD J. MOSSINGHOFF

*Attesting Officer*

*Commissioner of Patents and Trademarks*